US011484761B2

(12) United States Patent
Uhm

(10) Patent No.: US 11,484,761 B2
(45) Date of Patent: Nov. 1, 2022

(54) PORTABLE MAGNIFICATION ANGLE ADJUSTER FOR GOLF PUTTING

(71) Applicant: KAISHOT CO., LTD., Seoul (KR)

(72) Inventor: Hyun Duk Uhm, Seoul (KR)

( * ) Notice: Subject to any disclaimer, the term of this patent is extended or adjusted under 35 U.S.C. 154(b) by 0 days.

(21) Appl. No.: 17/175,695

(22) Filed: Feb. 14, 2021

(65) Prior Publication Data

US 2021/0268357 A1 Sep. 2, 2021

(30) Foreign Application Priority Data

Feb. 24, 2020 (KR) ..... 10-2020-0022116

(51) Int. Cl.
*A63B 69/36* (2006.01)
*A63B 102/32* (2015.01)

(52) U.S. Cl.
CPC ..... *A63B 69/3685* (2013.01); *A63B 2102/32* (2015.10); *A63B 2220/18* (2013.01)

(58) Field of Classification Search
CPC ..... A63B 69/3685; A63B 2102/32; A63B 2220/18; A63B 69/3676; A63B 2220/24; G01B 5/24
See application file for complete search history.

(56) References Cited

U.S. PATENT DOCUMENTS 994,521 A * 6/1911 Jacobs ..... G01C 9/12 33/283
5,038,489 A * 8/1991 Muehlenbein ..... A61B 5/1071 33/1 BB
5,662,535 A * 9/1997 Smith ..... A63B 69/3676 473/404
5,792,015 A * 8/1998 Hoyt ..... G01C 9/12 33/391
10,293,236 B2 * 5/2019 Uhm ..... A63B 69/3676
2006/0073916 A1 * 4/2006 Lin ..... A63B 57/00 473/404

FOREIGN PATENT DOCUMENTS

CN 203837697 U 9/2014
KR 101484550 B1 * 1/2015
KR 10-1774012 B1 9/2017

* cited by examiner

*Primary Examiner* — Steven B Wong

(57) ABSTRACT

A portable magnification angle adjuster for golf putting is proposed. More particularly, in the portable magnification angle adjuster for golf putting, the decrease of the beauty and portability of the magnification angle adjuster due to the protruding of the knob from the casing during the rotation of a knob for the rectilinear movement of a rotation weight is prevented, and the range of the engagement of threads formed to move the rotation weight is limited such that the moving distance of the rotation weight is limited. To this end, the portable magnification angle adjuster includes: a casing; an indication hand; a knob; and a dial; and a rotation weight.

6 Claims, 6 Drawing Sheets

PORTABLE MAGNIFICATION ANGLE ADJUSTER FOR GOLF PUTTING

CROSS REFERENCE TO RELATED APPLICATION

The present application claims priority to Korean Patent Application No. 10-2020-0022116, filed Feb. 24, 2020, the entire contents of which is incorporated herein for all purposes by this reference.

BACKGROUND OF THE INVENTION

Field of the Invention

The present disclosure relates generally to a portable magnification angle adjuster for golf putting. More particularly, the present disclosure relates to a portable magnification angle adjuster for golf putting, in which irrespective of the position of a rotation weight, the beauty and portability of the magnification angle adjuster is improved, and the precision of the measurement of a golf green slope is prevented from decreasing.

Description of the Related Art

Generally, a putting motion on a golf green occurs at a final stage in which a golfer puts a golf ball into a hole cup, and is one of motions which require the golfer's concentration and accuracy.

Meanwhile, since the slope surface of a golf course green is designed to have various types of inclinations, it is necessary to accurately determine the slope of a place on which a golf ball is placed, the slope of the hole cup, and the slope between the hole cup and the golf ball so as to increase the success rate of putting. However, generally, golfers are not accurate in determining the slope of a golf green, and thus are not accurate in putting, either. Accordingly, there are several products on the market that can easily measure the slope of the golf green as an auxiliary means for increasing precision when determining the slope of the golf green during putting. However, a conventional product by which the slope of a golf green can be measured has a very low efficiency in improving the precision of putting since the direction of the hole cup actually marked by the conventional product and the center position of the hole cup are inconsistent.

In order to solve this problem, the present applicant proposed "Direction indication device for golf putting" disclosed in Korean Patent No. 10-1774012 as illustrated in FIG. 1, in which a slope between a position of a golf green on which a golf ball is placed and a position at which a hole cup is located is easily measured, and a putting direction is indicated by an indication hand such that the accuracy of putting angle and direction is increased to suit the individual putting characteristics of each golfer.

Meanwhile, although the actual inclination angle of a golf green is the same, it is necessary to minutely adjust a putting magnification angle to suit a putting habit of each golfer according to the individual putting characteristics of the golfer. That is, as illustrated in FIG. 1, a golfer sets the rotation magnification angle of the indication hand 30 while moving a first rotation cam 20 forward or backward by rotating a knob 10 according to each golfer's putting habit. The direction indication device for golf putting is configured such that each golfer individually sets the rotation magnification angle for a golf green slope in consideration of the golfer's putting characteristics. When the golfer rotates the knob 10 in a forward/reverse direction, an angle adjustment bar 40 moves forward or backward and changes the position of the first rotation cam 20, and the rotation magnification angle of the indication hand 30 may be adjusted as the position of the first rotation cam 20 on the rotation end part of the indication hand 30 changes.

However, in the conventional direction indication device for golf putting, threads are formed on the entire outer circumferential surface of the angle adjustment bar 40, so during the movement of the first rotation cam 20 due to the rotation of the angle adjustment bar 40, the angle adjustment bar 40 moves together with the first rotation cam 20. Accordingly, in the conventional direction indication device for golf putting, during the rotation of the knob 10 for the movement of the first rotation cam 20, the angle adjustment bar 40 protrudes to the outside, so the exterior beauty of the direction indication device may deteriorate, and when the direction indication device is carried, the protruding angle adjustment bar 40 interferes with a user's body or trouser pocket, thereby deteriorating the portability of the direction indication device.

In addition, when the golfer moves the first rotation cam 20 to adjust the position of the first rotation cam 20, the first rotation cam 20 may touch a first support 50 due to the excessive movement of the first rotation cam 20. Accordingly, the first rotation cam 20 may not efficiently rotate due to the friction of the first rotation cam 20 with the first support 50, so the precision of slope angle measurement by the direction indication device for golf putting may be decreased.

DOCUMENT OF RELATED ART (Patent Document 1) Korean Patent No. 10-1774012

SUMMARY OF THE INVENTION

Accordingly, the present disclosure has been made keeping in mind the above problems occurring in the related art, and the present disclosure is intended to propose a portable magnification angle adjuster for golf putting, in which a knob and a rotation weight are screwed to each other, and threads are formed only on a portion of a push puller to move the knob and the rotation weight, whereby the knob can move the rotation weight without protruding from a casing, and the moving distance of the rotation weight is limited such that the rotation weight is efficiently rotated irrespective of the position of the rotation weight.

In order to achieve the above objective, according to one aspect of the present disclosure, there is provided a portable magnification angle adjuster for golf putting, the magnification angle adjuster including: a casing having an inner space formed therein and having an insertion hole formed at a side of the casing toward the inner space; an indication hand shaft-coupled to the casing such that the indication hand rotates in the inner space of the casing, the indication hand including a longitudinal pin hole; a knob including: a spiral shaft inserted into the inner space of the casing through the insertion hole; and a dial formed at an end part of the spiral shaft and located at an outside of the casing, the dial having a diameter larger than a diameter of the insertion hole; and a rotation weight coupled to the spiral shaft in the inner space of the casing such that the rotation weight rotates relative to the spiral shaft in opposite circumferential directions of the spiral shaft, and having a rotation pin formed in the rotation weight, the rotation pin being located at the longitudinal pin hole of the indication hand, wherein the spiral shaft and the rotation weight are screwed to each other such that the rotation weight is moved on the spiral shaft through a rotation of the dial, and threads of the rotation weight and threads of the spiral shaft are formed on a portion of the rotation weight and a portion of the spiral shaft, respectively, such that during the rotation of the dial, the rotation weight moves within a range in which the threads of the rotation weight and the threads of the spiral shaft are engaged with each other.

In this case, a hollow center hole may be formed in the rotation weight, the rotation weight may have a through hole formed through each of opposite sides of the hollow center hole in a coupling direction of the rotation weight to the spiral shaft, and the rotation weight may further include: a push puller arranged in the hollow center hole and configured to have a width such that a gap occurs between the push puller and the hollow center hole and to have a screw hole formed in the push puller such that the screw hole communicates with the through hole of the rotation weight, so that the push puller is screwed to the spiral shaft.

In this case, the through hole of the rotation weight may include a longitudinal lower hole corresponding to the screw hole of the push puller, and an upper hole having a circular shape formed above the longitudinal lower hole, and an inner through hole corresponding to the upper hole may be formed above the screw hole of the push puller, wherein the magnification angle adjuster may further include: a guide shaft having a first end part fixed to the casing and having a second end part inserted into the inner through hole of the push puller through the upper hole of the rotation weight such that the guide shaft guides a movement of the rotation weight during a movement of the push puller caused by a rotation of the dial.

The threads of the spiral shaft may be formed on an outer circumferential surface of the spiral shaft and threads may be formed in the screw hole of the push puller, wherein the threads of the spiral shaft and the threads of the screw hole may be formed only on a portion of the outer circumferential surface of the spiral shaft and in a portion of the screw hole, respectively, such that the movement of the rotation weight due to the threads of the spiral shaft and the threads of the push puller engaged with each other is limited.

In addition, in the threads of the spiral shaft, threads formed on a center part of the spiral shaft may be configured to have diameters larger than diameters of threads formed on opposite end portions of the spiral shaft in a longitudinal direction of the spiral shaft.

The portable magnification angle adjuster for golf putting according to the present disclosure has the following effects.

First, in the portable magnification angle adjuster for golf putting, the spiral shaft is screwed only to the push puller inside the casing, and freely rotates in the casing, whereby the knob including the spiral shaft is prevented from protruding to the outside of the casing. Accordingly, in the portable magnification angle adjuster for golf putting, the spiral shaft is prevented from protruding to the outside of the casing, thereby preventing the decrease of the beauty and portability of the portable magnification angle adjuster which may occur due to interference of the spiral shaft with a user's body or trouser pocket when the portable magnification angle adjuster is carried.

Second, in the portable magnification angle adjuster for golf putting, when the dial is turned, the spiral shaft is rotated, and due to the screw hole of the push puller coupled to the spiral shaft, the push puller is moved, so the rotation weight axially coupled to the guide shaft is also moved in cooperation with the push puller. In this case, threads formed on the outer circumferential surface of the spiral shaft are configured as threads tapered toward opposite sides of the center part of the spiral shaft relative to threads of the center part and are engaged with threads formed in the screw hole of the push puller. The tapered threads are disengaged from the threads formed in the screw hole of the push puller at the opposite ends thereof, so the moving distance of the push puller and the moving distance of the rotation weight can be limited, and even in the state in which the push puller is disengaged from the spiral shaft, the rotation of the rotation weight can be efficiently performed. In addition, even after the spiral shaft is disengaged from the push puller due to the tapered threads of the spiral shaft, the recoupling of the spiral shaft to the screw hole of the push puller can be easily performed by turning the knob in the contrary direction. Accordingly, in the portable magnification angle adjuster for golf putting, the rotation of the rotation weight can be efficiently performed, thereby consistently maintaining the precision of golf putting.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Unless otherwise defined, terms or words used in the specification and claims are not limited to meanings that are commonly understood or are defined in dictionaries, and should be interpreted as having meanings and concepts that are consistent with the context of the present disclosure, based on the principle that an inventor may properly define concepts of words so as to describe his or her invention in the best mode.

Hereinafter, a portable magnification angle adjuster for golf putting according to the exemplary embodiment of the present disclosure will be described with reference to FIGS. 2 to 6.

According to the portable magnification angle adjuster for golf putting, the slope of a golf green is easily measured to increase the precision of putting by a golfer, and during the rotation of a knob for adjusting the position of a rotation weight, the knob is prevented from protruding from the casing. Accordingly, the portable magnification angle adjuster for golf putting prevents exterior beauty thereof from deteriorating and does not cause discomfort even when the portable magnification angle adjuster is carried.

Figure 1:
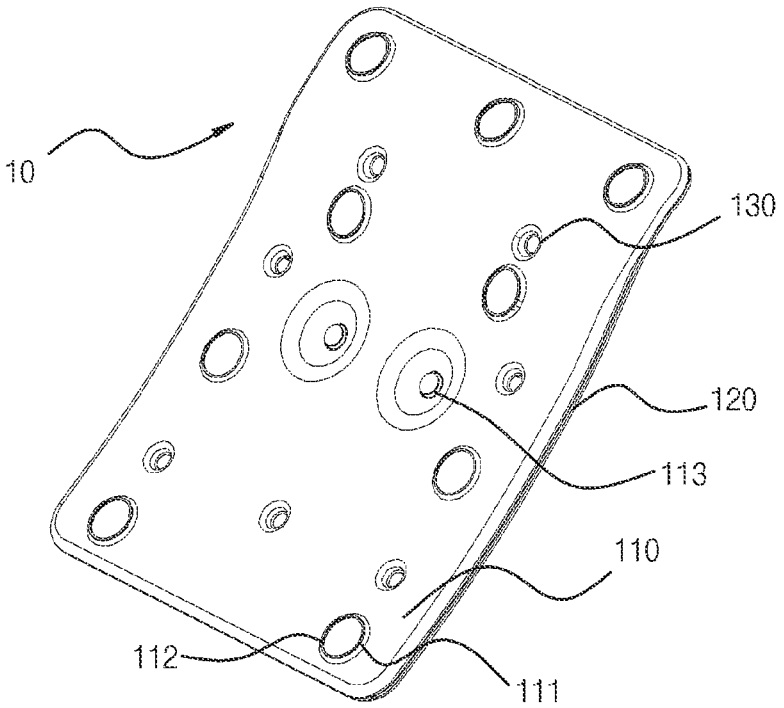
PRIOR ART FIG. 1
FIG. 1 is a perspective view illustrating a direction indication device for golf putting according to a conventional technology.
Figure 2:
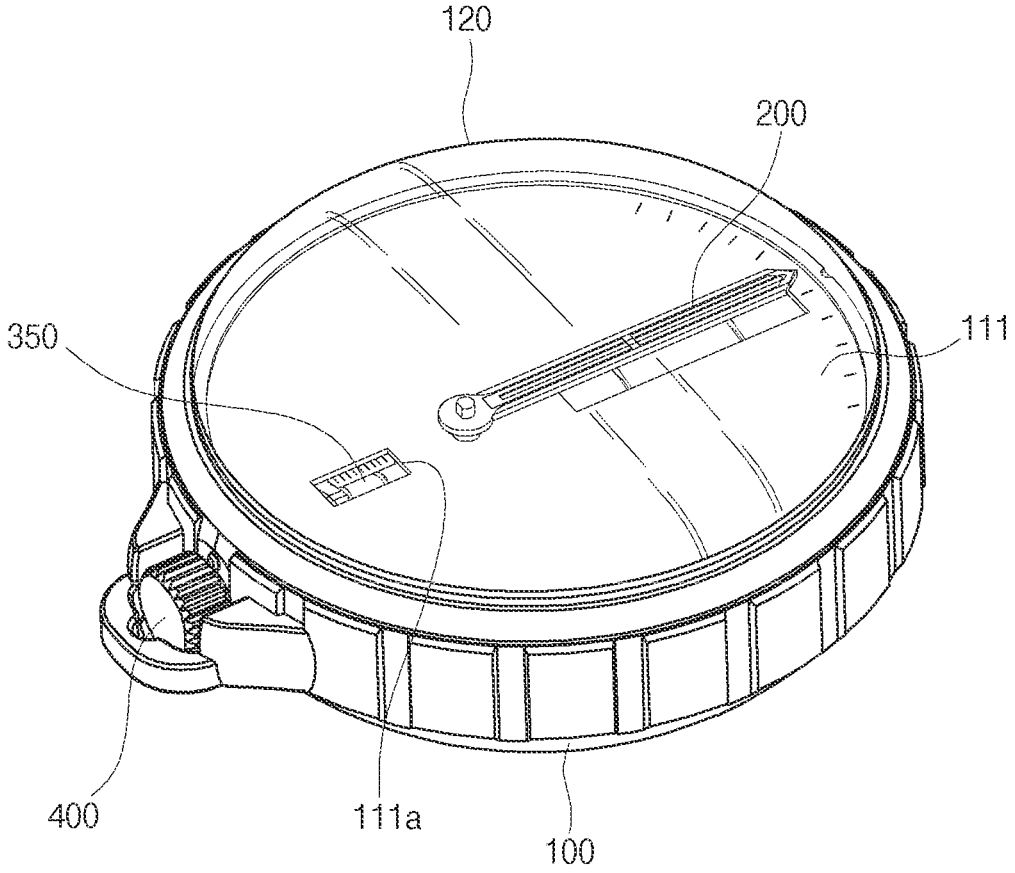
FIG. 2 is a perspective view illustrating a portable magnification angle adjuster for golf putting according to an exemplary embodiment of the present disclosure.
Figure 3:
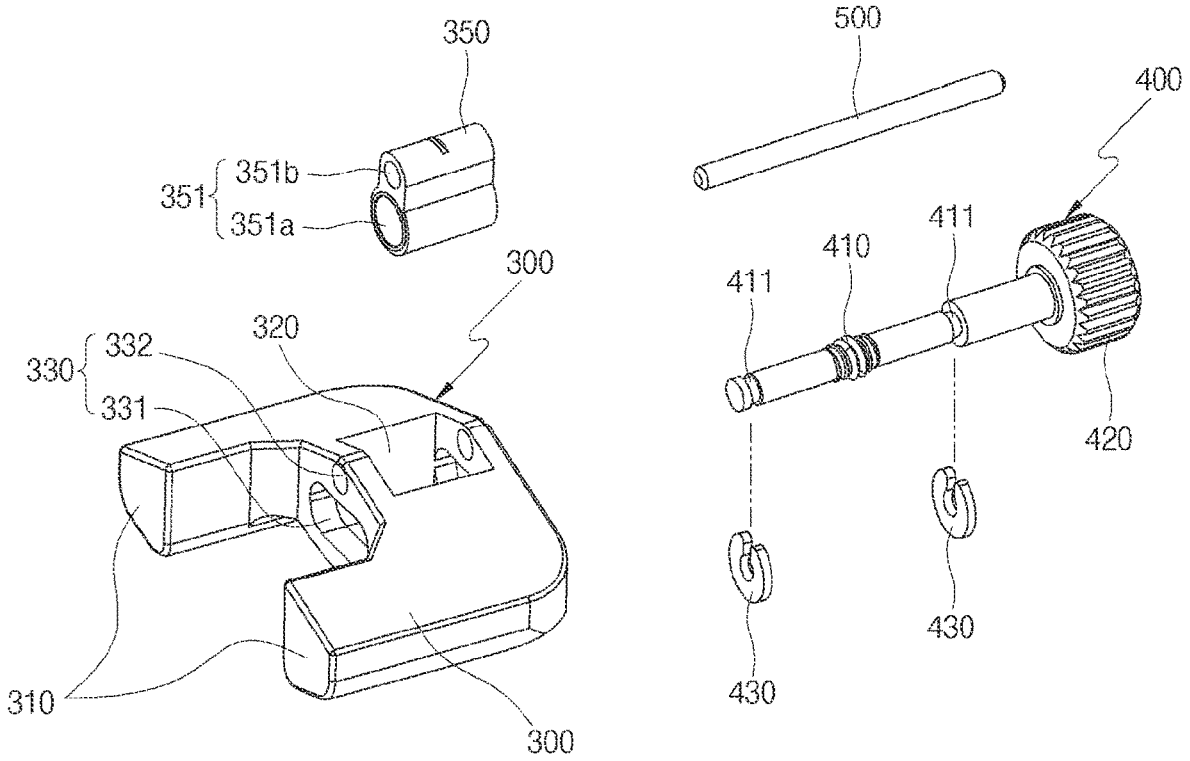
FIG. 3 is an exploded perspective view of important parts of the portable magnification angle adjuster for golf putting according to the exemplary embodiment of the present disclosure.

As illustrated in FIGS. 2 and 3, the portable magnification angle adjuster for golf putting includes a casing 100, an indication hand 200, a rotation weight 300, a knob 400, and a guide shaft 500.

The casing 100 constitutes the exterior of the portable magnification angle adjuster for golf putting, and has inner space 110 in which each component is installed. The casing 100 is preferably formed to have a circular shape, and a side thereof is open such that the bottom of the inner space 110 is seen. In this case, an angle display panel 111 is installed at the upper part of the inner space 110, and is configured such that the golfer can visually check the rotation angle of the indication hand 200. As illustrated in FIG. 2, a check window 111*a* communicating with the inner space 110 is installed at a side of the angle display panel 111. The check window 11*a* is configured such that the golfer checks the present moving position of a push puller 350 to be described later. The position of the check window 11*a* corresponds to the position of the push puller 350. In this case, a scale is preferably marked on the check window 11*a* such that the present moving position of the push puller 350 is recognized. As described above, since the golfer can check the present position of the push puller 350 through the check window 11*a*, the setting point of a magnification angle suitable for the golfer's own putting characteristics can be easily adjusted.

A transparent window 120 is installed at a side of the casing 100 and the golfer can look into the angle display panel 111 through the transparent window 120. Insertion holes 130 are formed at a side of an outer circumferential surface of the casing 100. The insertion holes 130 are holes through which the spiral shaft 410 and the guide shaft 500 of the knob 400 to be described later pass, and are formed as simple through holes to allow the inside and outside of the casing 100 to communicate with each other.

Figure 6:
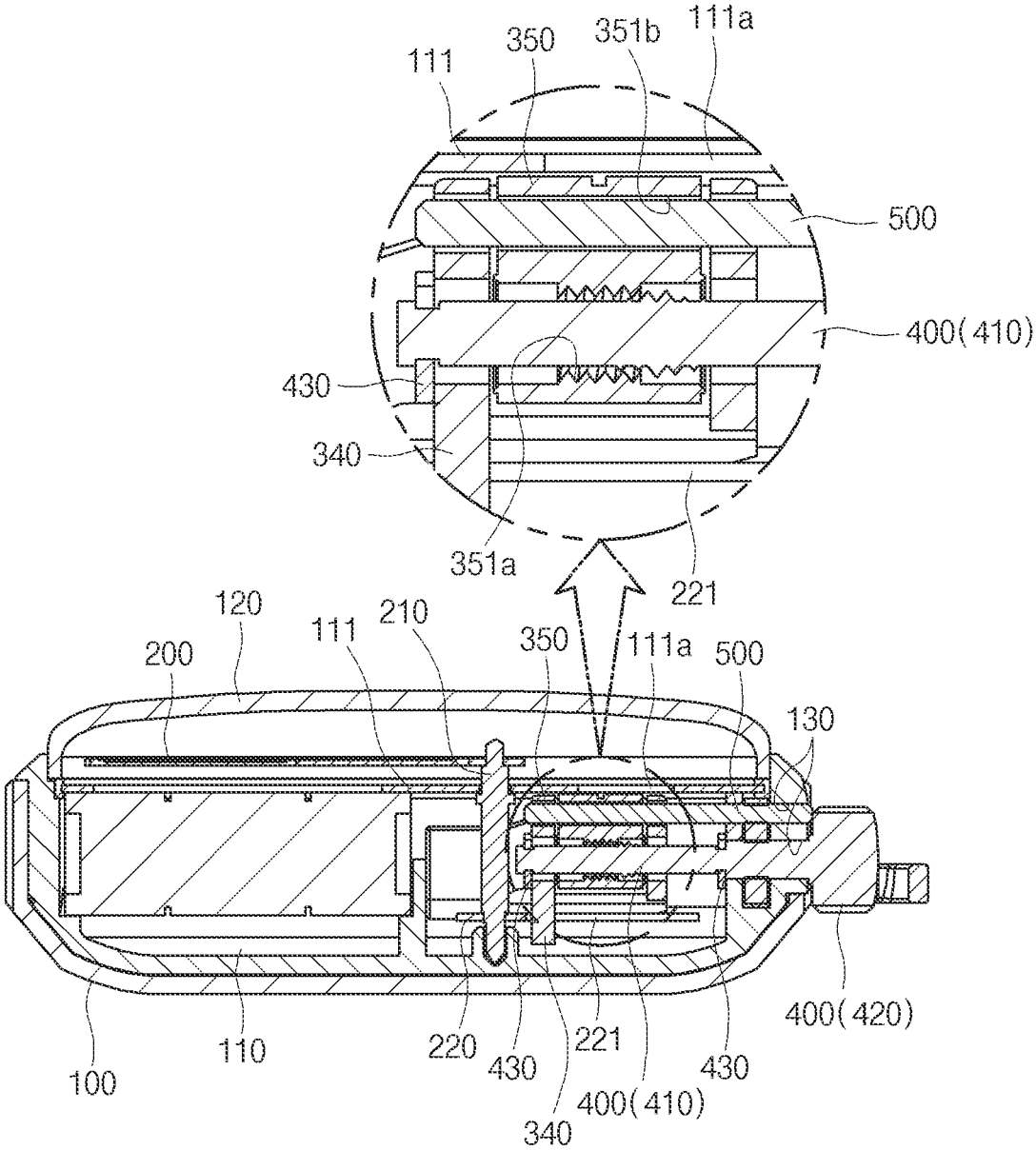
FIG. 6 is a sectional view illustrating the portable magnification angle adjuster for golf putting according to the exemplary embodiment of the present disclosure.

While the indication hand 200 rotates according to the rotation of the rotation weight 300, that is, according to the slope of the casing 100, the indication hand 200 is configured to indicate the scale of the angle display panel 111 of the casing 100. As illustrated in FIG. 6, the indication hand 200 is axially coupled to a vertical shaft 210 such that the indication hand 200 freely rotates in the inner space 110 of the casing 100. In this case, a lower end pin 220 is coupled to the lower end part of the vertical shaft 210. The lower end pin 220 functions to transmit the rotating force of the rotation weight 300 to the indication hand 200 through the vertical shaft 210 such that the indication hand 200 is rotated by a degree of the rotation angle of the rotation weight 300. The lower end pin 220 includes a longitudinal pin hole 221 formed therein in the longitudinal direction thereof. The pin hole 221 of the lower end pin 220 is configured to adjust the rotation magnification range of the indication hand 200, and is configured to be fitted over a rotation pin 340 of the rotation weight 300 to be described later. According to a position of the pin hole 221 in which the rotation pin 340 of the rotation weight 300 is placed, the rotation magnification range of the indication hand 200 can be changed.

Figure 4:
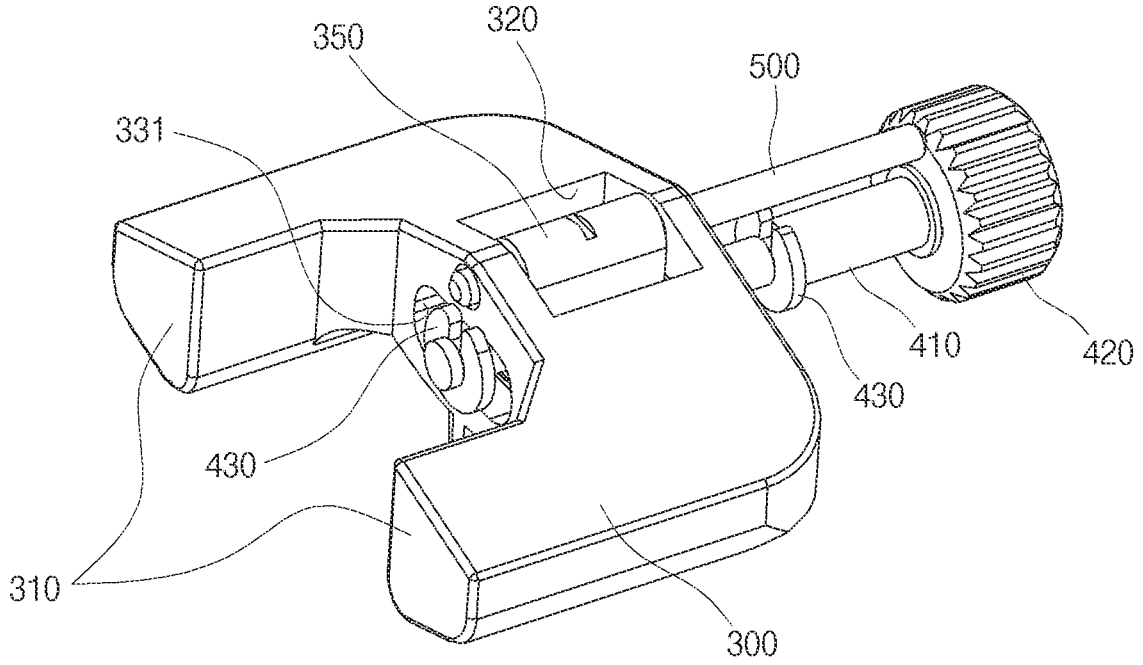
FIG. 4 is a perspective view illustrating the important parts of the portable magnification angle adjuster for golf putting according to the exemplary embodiment of the present disclosure.

The rotation weight 300 functions to rotate the indication hand 200 while the rotation weight 300 rotates in the inner space 110 of the casing 100 according to the slope of a golf course green on which the casing 100 is placed. The rotation weight 300 allows the rotating force thereof to be transmitted to the indication hand 200 through the lower end pin 220 and the vertical shaft 210 such that the rotation weight 300 rotates the indication hand 200 in cooperation with the indication hand 200. The rotation weight 300 is provided to be rotatable while the rotation weight 300 is axially coupled to the guide shaft 500 to be described later. The rotation weight 300 has a center of gravity located at the lower end of the guide shaft 500 such that the rotation weight 300 is efficiently rotated, and is preferably formed to incline toward the opposite sides of the rotation weight 300. In addition, as illustrated in FIGS. 3 and 4, an extension wing 310 is formed at each of the opposite sides of the rotation weight 300 to make the rotation weight 300 as heavy as possible, and a center hole 320 is formed in the center of the rotation weight 300. The center hole 320 is space in which the push puller 350 to be described later is arranged to rotate and move the rotation weight 300. A through hole 330 is formed in the rotation weight 300. The through hole 330 is formed in the coupling direction of the rotation weight 300 to the guide shaft 500. The through hole 330 is divided into a lower hole 331 and an upper hole 332 in the height direction of the rotation weight 300. The lower hole 331 is formed to have the shape of a longitudinal hole in the width direction of the rotation weight 300, and has a size of space such that the lower hole 331 does not touch the spiral shaft 410 during the rotation of the rotation weight 300 leftward and rightward. The upper hole 332 is formed to have a circular shape above the lower hole 331. The upper hole 332 is configured such that the guide shaft 500 to be described later is inserted to the upper hole 332, and allows the rotation weight 300 to move along the guide shaft 500 during the rectilinear movement of the rotation weight 300. The upper hole 332 is formed as a shape of a simple through hole. The rotation pin 340 extending downward is formed in the rotation weight 300. The rotation pin 340 is inserted to the pin hole 221 of the lower end pin 220, and during the rotation of the rotation weight 300, transmits the rotating force of the rotation weight 300 to the vertical shaft 210 such that the indication hand 200 is rotated. That is, while the rotation pin 340 is inserted to the pin hole 221 during the rotation of the rotation weight 300, the rotation pin 340 rotates the lower end pin 220, and rotates the indication hand 200 located at the upper end of the vertical shaft 210 toward a first or second side thereof.

Figure 5:
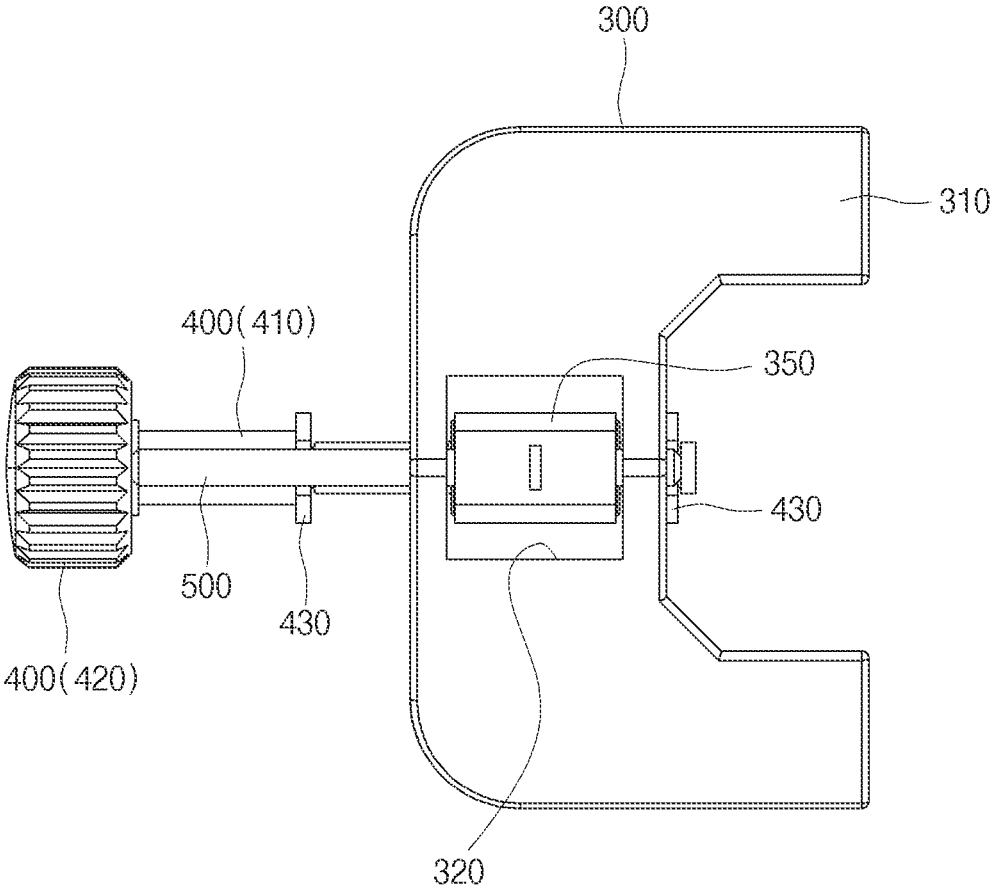
FIG. 5 is a top plan view illustrating important parts of the portable magnification angle adjuster for golf putting according to the exemplary embodiment of the present disclosure.

The push puller 350 is inserted to and installed in the center hole 320 of the rotation weight 300. The push puller 350 functions as a medium moving the rotation weight 300 while being axially coupled to the guide shaft 500. The push puller 350 is located in the center hole 320 of the rotation weight 300, and a through hole 351 is formed in the push puller 350 in a height direction thereof. The through hole 351 is composed of a screw hole 351*a* and an inner through hole 351*b*, wherein the screw hole 351*a* corresponds to the lower hole 331 of the rotation weight 300. The screw hole 351*a* is formed to have a circular shape, and has threads formed therein to be screwed to the spiral shaft 410 to be described later. The inner through hole 351*b* is formed above the screw hole 351*a*, and corresponds to the upper hole 332 of the rotation weight 300. The inner through hole 351*b* is axially fitted over the guide shaft 500 and is configured to help the axial movements of the push puller 350 and the rotation weight 300 along the guide shaft 500. The inner through hole 351*b* is provided to have a shape of a simple through hole. Meanwhile, the push puller 350 is formed to have a width smaller than the width of the center hole 320. Accordingly, as illustrated in FIG. 5, a gap occurs between the center hole 320 and the push puller 350, so during the rotation of the rotation weight 300, little frictional force occurs between the rotation weight 300 and the push puller 350. Accordingly, the push puller 350 does not interfere with the rotation of the rotation weight 300.

The knob 400 functions to rectilinearly move the rotation weight 300. Specifically, the knob 400 functions to move the rotation weight 300 forward or backward by being rotated. The knob 400 includes the spiral shaft 410, a dial 420, and removal prevention rings 430. The spiral shaft 410 is screwed to the screw hole 351*a* of the push puller 350 through the casing 100. Threads are formed on the spiral shaft 410, and are not formed on the entirety of the spiral shaft 410, but are formed only on a portion of the spiral shaft 410 as illustrated in FIGS. 3 and 6. This is intended to limit the moving distance of the rotation weight 300. The detailed description of this will be described later. A ring groove 411 is formed at each of the longitudinal opposite end parts of the spiral shaft 410 along a circumference thereof. The dial 420 is a component grasped by a golfer to turn the spiral shaft 410, and is provided at the end part of the spiral shaft 410. The dial 420 is located at the outside of the casing 100, and protrusions are preferably formed on the dial 420 such that the dial 420 is easily turned by the hand of an operator. A removal prevention ring 430 located at an end of the spiral shaft 410 prevents the removal of the rotation weight 300 from the spiral shaft 410 during the movement of the rotation weight 300 on the spiral shaft 410. Furthermore, a removal prevention ring 430 located at the inner surface of the casing 100 is a holding component provided to locate the dial 420 at the outside of the casing 100 and to locate the spiral shaft 410 at the inside of the casing 100 through the insertion hole 130 of the casing 100. Each of the removal prevention rings 430 is fitted to the ring groove 411 of the spiral shaft 410, and is preferably an e-ring.

Meanwhile, as described above, the spiral shaft 410 of the knob 400 and the push puller 350 are screwed to each other, and due to the rotation of the spiral shaft 410, the push puller 350 moves rectilinearly along the spiral shaft 410, and the rotation weight 300 also moves axially in cooperation with the push puller 350. In this case, as illustrated FIG. 6, the threads formed on the spiral shaft 410 and the threads formed in the screw hole 351*a* of the push puller 350 are formed only on a portion of the spiral shaft 410 and in a portion of the screw hole 351*a*, respectively. In this case, as for the shape of the threads formed on the outer circumferential surface of the spiral shaft 410, the threads formed on opposite end portions of the spiral shaft 410 in the longitudinal direction of the spiral shaft 410 relative to threads located at the center part of the spiral shaft 410 are preferably configured to have diameters smaller than the diameters of the threads located at the center part. This can be known through the enlarged drawing of FIG. 6, and such a type of the threads is called tapered threads for convenience of description. That is, the threads formed on the spiral shaft 410 are configured as threads tapered toward the opposite ends thereof, and are engaged with the threads formed in the screw hole 351*a* of the push puller 350 and are disengaged from the threads formed in the screw hole 351*a* of the push puller 350 at the opposite ends thereof, whereby the moving distance of the push puller 350 and the moving distance of the rotation weight 300 can be limited, and even in the state in which the push puller 350 is disengaged from the spiral shaft 410, the rotation of the rotation weight 300 is efficiently performed. In addition, although the tapered threads of the spiral shaft 410 are removed from the screw hole 351*a* of the push puller 350, the recoupling of the spiral shaft 410 to the screw hole 351*a* of the push puller 350 can be easily performed by turning the knob 400 in the contrary direction.

The range of the threads formed on the spiral shaft 410 and in the screw hole 351*a*, respectively, is a range in which the rotation weight 300 is allowed to move such that the rotation weight 300 does not touch the removal prevention ring 430 coupled to each of the opposite end parts of the spiral shaft 410. In a case in which the rotation weight 300 touches the removal prevention ring 430 by being moved forward or backward, friction between the rotation weight 300 and the removal prevention ring 430 occurs during the rotation of the rotation weight 300, so the rotation of the rotation weight 300 is not efficiently performed. Accordingly, it is difficult to precisely measure the slope of a golf green through the indication hand 200. Accordingly, before the rotation weight 300 touches the removal prevention ring 430 during the movement of the rotation weight 300, the threads of the spiral shaft 410 and the threads of the screw hole 351*a* engaged with each other are disengaged from each other, so despite the continuous rotation of the knob 400, the rotation weight 300 can be prevented from being further moved.

The guide shaft 500 functions to allow the rotation weight 300 to be moved in the rectilinear course due to the rotation of the knob 400. As illustrated in FIG. 6, a first end part of the guide shaft 500 is fitted to the insertion hole 130 of the inner surface of the casing 100, and a second end part of the guide shaft 500 is inserted to the inner through hole 351*b* of the push puller 350 through the upper hole 332 of the rotation weight 300.

Hereinafter, the assembly and operation of the portable magnification angle adjuster for golf putting having the above configuration will be described.

While a side of the casing 100 is open, an operator shaft-couples the indication hand 200 to an upper end of the angle display panel 111 located at the inner upper end of the casing 100, and while the spiral shaft 410 and the guide shaft 500 of the knob 400 are fitted to the insertion holes 130 of the casing 100, the rotation weight 300 is installed in the inner space 110. The operator locates the rotation pin 340 of the rotation weight 300 in the pin hole 221 of the lower end pin 220, and screws the spiral shaft 410 to the screw hole 351*a* of the push puller 350 located in the center hole 320 of the rotation weight 300. In this process, the operator performs fitting the inner through hole 351*b* over the guide shaft 500. Next, the operator couples the transparent window 120 to an open side of the casing 100, so the assembly of the portable magnification angle adjuster for golf putting is completed.

In the portable magnification angle adjuster having the above configuration, the push puller 350 is axially coupled to the guide shaft 500 and moves according to the rotation of the spiral shaft 410, so the rotation weight 300 may also move and rotate in cooperation with the push puller 350. Accordingly, when the casing 100 is tilted to the right, the rotation weight 300 is also rotated to the right relative to the guide shaft 500. While the rotation weight 300 rotates, the rotation pin 340 of the rotation weight 300, which is located in the pin hole 221, rotates the lower end pin 220, and the indication hand 200 is rotated by the vertical shaft 210, whereby the indication hand 200 indicates the scale of the angle display panel 111 indicating the slope (inclination) of a golf green. Next, a golfer can determine the slope of a golf green and put a golf ball in direction indicated by the indication hand 200 to increase a putting success rate.

Meanwhile, due to golfers' putting characteristics, the slope of a golf green cannot be the same putting condition suitable for all the golfers, and depending on each of the golfers' putting characteristic, the inclination value of the golf green can be adjusted to match the golfer's putting stroke. To this end, a golfer may rotate the knob 400 to adjust the magnification of the rotation angle of the indication hand 200 indicating the slope of a golf green. That is, the golfer can adjust the magnification of the rotation angle of the indication hand 200 by adjusting the position of the rotation weight 300 in a forward/reverse direction while rotating the spiral shaft 410 by rotating the dial 420 of the knob 400. In this case, in the knob 400, the spiral shaft 410 is coupled to the screw hole 351*a* of the push puller 350 inside the inner space 110 of the casing 100, and is simply coupled to the insertion hole 130 of the casing 100, so due to the removal prevention ring 430 of the spiral shaft 410 located at the inner surface of the casing 100, the dial 420 rotates idly at the insertion hole 130 of the casing 100 despite the rotation of the dial 420 by the golfer. That is, in the portable magnification angle adjuster for golf putting, despite the rotation of the knob 400, the knob 400 is prevented from protruding from the casing 100, so the portable magnification angle adjuster prevents the exterior beauty thereof from deteriorating and does not cause discomfort even when the golfer carries the portable magnification angle adjuster.

Meanwhile, when the forward or backward movement of the rotation weight 300 is excessively performed, the engagement of the threads of the push puller 350 with the threads of the spiral shaft 410 is released, so the forward or backward movement of the rotation weight 300 no longer occurs despite the rotation of the knob 400. That is, in the portable magnification angle adjuster for golf putting, the excessive movement of the rotation weight 300 is limited, and thus the rotation weight 300 is prevented from being in contact with the removal prevention ring 430 installed at each of the opposite end parts of the spiral shaft 410, so the rotation of the rotation weight 300 can be efficiently performed. Accordingly, the portable magnification angle adjuster for golf putting allows the precision of the slope angle measurement of a golf green to be consistently maintained.

As described so far, in the portable magnification angle adjuster for golf putting according to the present disclosure, during the rotation of the knob 400 for changing the position of the rotation weight 300, the knob 400 is configured to be prevented from protruding from the casing 100, so the beauty of the exterior of the portable magnification angle adjuster is prevented from deteriorating, and the portability thereof is increased. In addition, in the portable magnification angle adjuster for golf putting, the excessive movement of the rotation weight 300 due to the rotation of the knob 400 is limited, so the rotation weight 300 is prevented from interfering with neighboring parts and the rotation of the rotation weight 300 is efficiently performed, whereby the precision of the measurement of a golf green slope can be consistently maintained.

As described above, the portable magnification angle adjuster for golf putting of the present disclosure is described in detail through the embodiment, but it is obvious to those skilled in the art that various changes and modifications are possible within the scope of the technical spirit of the present disclosure, and it is natural that such changes and modifications belong to the range of the appended claims.

What is claimed is:

1. A portable magnification angle adjuster for golf putting, the magnification angle adjuster comprising:

a casing having an inner space formed therein and having an insertion hole formed at a side of the casing toward the inner space;

an indication hand shaft-coupled to the casing such that the indication hand rotates in the inner space of the casing, the indication hand comprising a longitudinal pin hole;

a knob comprising: a spiral shaft inserted into the inner space of the casing through the insertion hole; and a dial formed at an end part of the spiral shaft and located at an outside of the casing, the dial having a diameter larger than a diameter of the insertion hole; and a rotation weight coupled to the spiral shaft in the inner space of the casing such that the rotation weight rotates relative to the spiral shaft in opposite circumferential directions of the spiral shaft, and having a rotation pin formed in the rotation weight, the rotation pin being located at the longitudinal pin hole of the indication hand, wherein the rotation weight comprises: a hollow center hole; a through hole formed through each of opposite sides of the hollow center hole in a coupling direction of the rotation weight to the spiral shaft; and a push puller arranged in the hollow center hole and configured to have a width such that a gap occurs between the push puller and the hollow center hole and to have a screw hole formed in the push puller such that the screw hole communicates with the through hole of the rotation weight, so that the push puller is screwed to the spiral shaft, and wherein the spiral shaft and the rotation weight are screwed to each other such that the rotation weight is moved on the spiral shaft through a rotation of the dial, and threads of the rotation weight and threads of the spiral shaft are formed on a portion of the rotation weight and a portion of the spiral shaft, respectively, such that during the rotation of the dial, the rotation weight moves within a range in which the threads of the rotation weight and the threads of the spiral shaft are engaged with each other.

2. The magnification angle adjuster of claim 1, wherein the through hole of the rotation weight comprises a longitudinal lower hole corresponding to the screw hole of the push puller, and an upper hole having a circular shape formed above the longitudinal lower hole, and an inner through hole corresponding to the upper hole is formed above the screw hole of the push puller, wherein the magnification angle adjuster further comprises: a guide shaft having a first end part fixed to the casing and having a second end part inserted into the inner through hole of the push puller through the upper hole of the rotation weight such that the guide shaft guides a movement of the rotation weight during a movement of the push puller caused by a rotation of the dial.

3. The magnification angle adjuster of claim 2, wherein the threads of the spiral shaft are formed on an outer circumferential surface of the spiral shaft and threads are formed in the screw hole of the push puller, wherein the threads of the spiral shaft and the threads of the screw hole are formed only on a portion of the outer circumferential surface of the spiral shaft and in a portion of the screw hole, respectively, such that the movement of the rotation weight due to the threads of the spiral shaft and the threads of the push puller engaged with each other is limited.

4. The magnification angle adjuster of claim 1, wherein in the threads of the spiral shaft, threads formed on a center part of the spiral shaft are configured to have diameters larger than diameters of threads formed on opposite end portions of the spiral shaft in a longitudinal direction of the spiral shaft.

5. The magnification angle adjuster of claim 2, wherein in the threads of the spiral shaft, threads formed on a center part of the spiral shaft are configured to have diameters larger than diameters of threads formed on opposite end portions of the spiral shaft in a longitudinal direction of the spiral shaft.

6. The magnification angle adjuster of claim 3, wherein in the threads of the spiral shaft, threads formed on a center part of the spiral shaft are configured to have diameters larger than diameters of threads formed on opposite end portions of the spiral shaft in a longitudinal direction of the spiral shaft.

* * * * *